United States Patent [19]

Walker

[11] 4,331,922

[45] May 25, 1982

[54] TEST APPARATUS FOR TESTING INTERNAL COMBUSTION SPARK IGNITION SYSTEMS

[75] Inventor: Michael J. Walker, Warley, England

[73] Assignee: Lucas Industries Limited, Birmingham, England

[21] Appl. No.: 152,128

[22] Filed: May 21, 1980

[30] Foreign Application Priority Data

May 25, 1979 [GB] United Kingdom ..... 7918387

[51] Int. Cl.[3] ..... F02P 17/00

[52] U.S. Cl. ..... 324/380

[58] Field of Search ..... 324/380, 381, 382, 385, 324/388

[56] References Cited

U.S. PATENT DOCUMENTS 4,101,822 7/1978 Doss et al. ..... 324/381

4,186,337 1/1980 Volk et al. ..... 324/380

*Primary Examiner*—Stanley T. Krawczewicz

*Attorney, Agent, or Firm*—Trexler, Bushnell & Wolters, Ltd.

[57] ABSTRACT

A test apparatus for testing internal combustion engine spark ignition systems includes input terminals for connection across the electronic switch of the ignition system under test. A plurality of comparators are connected to compare the voltage across the input terminals with different reference levels and the comparator outputs are connected via peak storage circuits to a logic circuit which drives indicators indicating various fault conditions.

6 Claims, 1 Drawing Figure

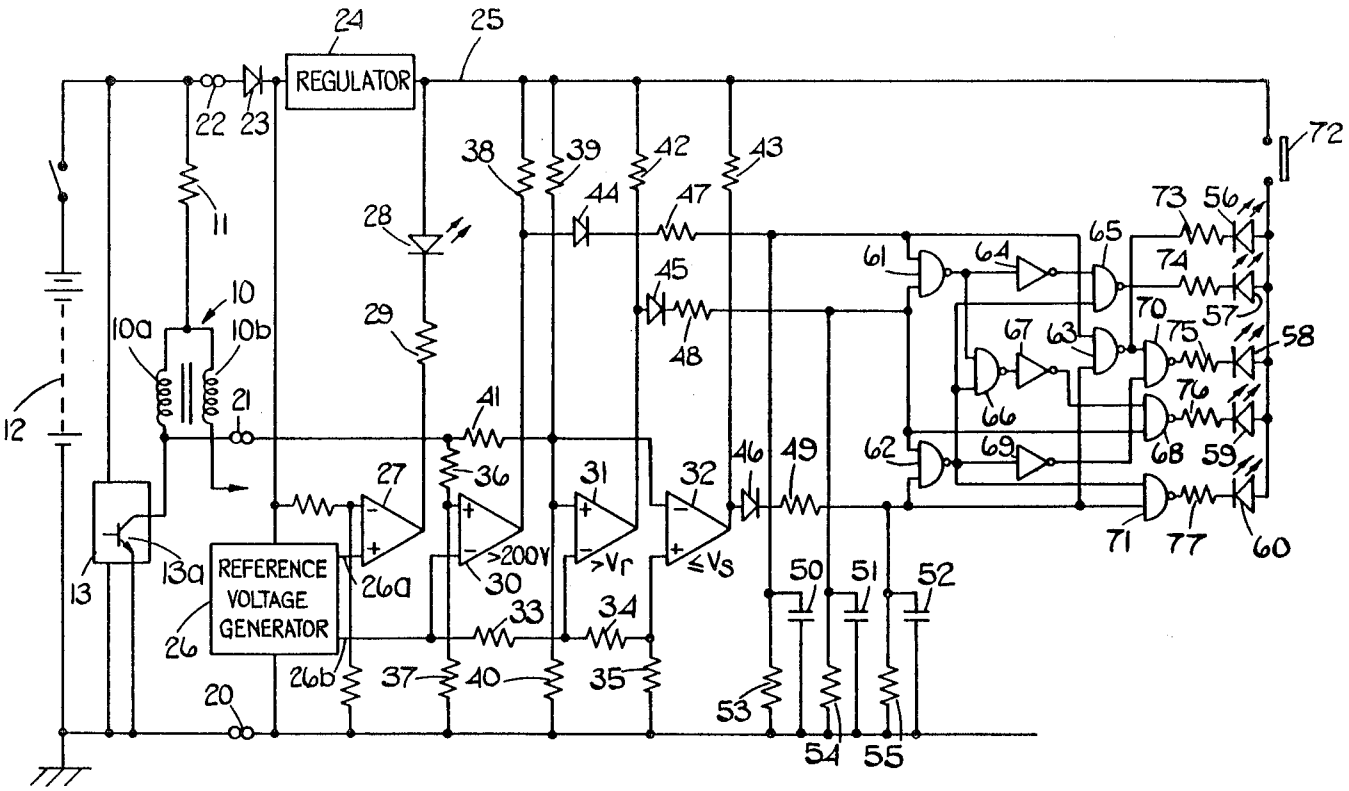
REGULATOR
REFERENCE VOLTAGE GENERATOR
≤Vs
>Vr
>200V

TEST APPARATUS FOR TESTING INTERNAL COMBUSTION SPARK IGNITION SYSTEMS

This invention relates to test apparatus for testing internal combustion engine spark ignition systems. It is an object of the invention to provide such an apparatus in a simple and convenient form capable of simple connection to the spark ignition system and able to display several different faults in spark ignition systems of the type employing an electronic switch in series with the primary winding of a step up ignition coil across a power supply such as a vehicle battery.

Test apparatus according to the invention comprises input terminals for connection across the electronic switch of the ignition system under test, a plurality of voltage comparator means connected to compare the voltage across said input terminals with a plurality of different reference voltages and arranged so that each comparator means periodically provides a predetermined output signal when the ignition system is functioning correctly, logic circuit means connected to said comparator means and a plurality of indicator devices connected to said logic circuit means, the arrangement being such that said indicator means operate to indicate different fault conditions according to which of the comparators fails to provide its predetermined output signal.

One of said comparator means may be connected to provide said predetermined output whenever the voltage across the input terminals is greater than a threshold indicating that the electronic switch is not conductive.

A second of the comparator means may be connected to provide its predetermined output signal when the voltage across the input terminals is less than a predetermined value lower than said threshold indicating that said electronic switch is saturating.

A third of the comparator means may be connected to provide its predetermined threshold signal whenever the voltage across the input terminals exceeds a predetermined high voltage indicating that a high voltage spike has appeared as a result of interruption of current flow through the primary winding.

Preferably each of the comparator means has a peak storage circuit connected to its output.

An example of the invention shown diagrammatically in the accompanying drawing is a circuit diagram of the test apparatus.

The ignition system to be tested is of the type using a voltage step up coil 10 having a primary winding 10*a* and a secondary winding 10*b* connected together at one end and with that common end connected by a ballast resistor 11 to the positive terminal of a battery 12. An electronic switch 13 controls current flow in the coil primary winding and includes an output transistor 13*a* connecting the other end of the primary winding to earth. The other end of the secondary winding is connected as is usual to the spark plugs (not shown) via an ignition distributor (not shown).

The test apparatus itself has three terminals 20, 21, 22 for connection respectively to the battery earth terminal the said other end of the coil primary winding 10*a* and the battery positive terminal.

Terminal 22 is connected to the anode of a diode 23, the cathode of which is connected via a series type voltage regulator 24 to a +ve supply rail 25. The cathode of the diode 23 is also connected to a terminal of a reference voltage generator circuit 26 which provides at two output termials 26*a*, 26*b* two different reference voltage signals referenced to the earth potential. One output terminal 26*a* is connected to the non-inverting input of a voltage comparator 27 the inverting input of which is connected to the junction of two resistors 28 and 29 in series between the cathode of diode 23 and the earth terminal 20. A light emitting diode indicator 28 has its anode connected to the rail 25 and its cathode connected via a resistor 29 to the output of comparator 27. Diode 28 lights if the battery voltage is satisfactory.

Three comparators 30, 31 and 32 are provided for comparing the voltage at said other end of the primary winding with proportions of the reference voltage at terminal 26*b*. Comparator 30 has its inverting terminal connected directly to terminal 26*b*, which is connected to earth by three resistors 33, 34 and 35 in series. The non-inverting input of comparator 30 is connected to the common point of two resistors 36 and 37 which are in series between the terminal 21 and earth. A load resistor 38 is connected between the rail 25 and the output of the comparator 30, the latter having an open collector output stage. The resistors 36, 37 are so chosen in relation to the reference voltage at terminal 26*b* that the output of comparator 30 is low except when the voltage between terminals 20 and 21 is in excess of about 200 V.

The comparator 31 has its non-inverting input connected to the junction of three resistors 39, 40 and 41, of which two (39 and 40) are in series between rail 25 and earth and the remaining resistor 41 is connected to the terminal 21. The inverting input of comparator 31 is connected to the junction of resistors 33 and 34 and its output is connected by a load resistor 42 to the rail 25. The resistors 33 to 35 and 39 to 41 are chosen in relation to the reference voltage at terminal 26*b* so that the output of comparator 31 is low except when the voltage across terminals 20, 21 is in excess of 8.5 V. The resistors 39 to 41 are also chosen to ensure that the voltage of their junction does not exceed the voltage on rail 25 when the input voltage is at its peak (up to b 400 V).

Comparator 32 has its inverting input connected to the junction of resistors 39 to 41 and its non-inverting input connected to the junction of resistors 34 and 35. Its output is connected by a load resistor 43 to the rail 25. The output of comparator 32 is low except when the voltage between terminals 20 and 21 is less than 1.9 V.

Three diodes 44, 45 and 46 have their anodes connected to the outputs of respective ones of the comparators 30, 31 and 32 and their cathodes connected by respective resistors 47, 48 and 49 in series with respective capacitors 50, 51 and 52 to earth. Three resistors 53, 54 and 55 are connected in parallel with respective ones of the capacitors 50, 51 and 52, the capacitors being charged rapidly via the associated diodes and series resistors when their respective comparator outputs go high, and discharged relatively slowly via their individual parallel resistors.

A logic circuit is provided for illuminating a plurality of light emitting diodes 56, 57, 58, 59 and 60 in various combinations according to the states of charge of the capacitors 50 to 52. This logic circuit includes a NAND gate 61 with its inputs connected to capacitors 50 and 51 a NAND gate 62 with its inputs connected to capacitors 51 and 52 and a NAND gate 63 with its inputs connected to capacitors 50 and 52. The output of NAND gate 61 is connected via an inverter 64 to one input of a NAND gate 65 which has its other input connected to the output of gate 62. NAND gate 61 also has its output connected to one input of a NAND gate 66 which has its other input connected to the output of gate 62. The output of gate 66 is connected via an inverter 67 to one input of a NAND gate 68 the other input of which is connected to capacitor 51. The output of gate 62 is connected via an inverter 69 to one input of a NAND gate 70, the other input of which is connected to the output of gate 63. Finally a NAND gate 71 has one input connected to the capacitor 52 and its other input connected to the output of gate 62.

The light emitting diodes 56 to 60 have their anodes connected together and via a switch contact 72 to the rail 25. The cathodes of these diodes are connected by respective resistors 73 to 77 to the outputs of gates 63, 65, 70, 68 and 71 respectively.

In use the switch contact 72 is closed when it is required to carry out a test, for example during starting of the engine the ignition system of which is under test. While the engine is being cranked, the ignition system should operate normally with the output transistor 13*a* turning on periodically to allow current to build up in primary winding 10*a* and then turning off to interrupt the current and cause a high voltage spark. The comparator 31 detects the voltage across the terminals 20, 21 when the vehicle ignition is switched on but the transistor 13*a* is switched off. If this voltage is more than 8.3 V the output of comparator 31 goes high and capacitor 51 is charged up. Comparator 32 detects the voltage when the transistor 13*a* is switched on. If this voltage is less than 1.9 V this indicates that transistor 13*a* is properly switched on, and the output of comparator 32 goes high. As previously mentioned the comparator 30 detects when the input terminal voltage exceeds about 200 V, indicating that a leakage reactance spike has occurred as a result of the transistor 13*a* switching off following a period of conduction.

Light emitting diode 56 is energised if both capacitors 50 and 52 have charged up and indicates that the ignition system has none of the faults detectable by this apparatus. Light emitting diode 57 is energized if capacitors 50 and 51 are charged up, but capacitor 52 is not. This indicates that the transistor 13*a* is not saturating when switched on. Light emitting diode 58 is energised when capacitor 50 has not charged up, but capactiors 51 and 52 have. This indicates that no 200 V spike has been produced. Light emitting diode 59 is energised if capacitor 51 has charged up but capacitor 50 and 52 have not. This indicates that the transistor 13*a* is not switching on at all. Finally, light emitting diode 60 is energised if the capacitor 52 is charged up, but capacitor 51 is not. This indicates that the transistor 13*a* is switched on continuously.

The apparatus described may be employed as a self-contained instrument or it may be part of a more complex ignition system test apparatus and used only during cranking to indicate (or eliminate) the simple faults which it can detect, before more complex tests are carried out with the engine running.

I claim:

1. Test apparatus for testing internal combustion engine spark ignition systems, comprising input terminals for connection across the electronic switch of the ignition system under test, a plurality of voltage comparator means connected to compare the voltage across said input terminals with a plurality of different reference voltages and arranged so that each comparator means periodically provides a predetermined output signal when the ignition system is functioning correctly, logic circuit means connected to said comparator means and a plurality of indicator devices connected to said logic circuit means, the arrangement being such that said indicator devices operates to indicate different fault conditions according to which of the comparator means fails to provide its predetermined output signal.

2. Test apparatus as claimed in claim 1 in which one of said comparator means is connected to provide said predetermined output whenever the voltage across the input terminals is greater than a threshold indicating that the electronic switch is not conductive.

3. Test apparatus as claimed in claim 2 in which a second of said comparator means is connected to provide its predetermined output signal when the voltage across the input terminals is less than a predetermined value lower than said threshold indicating that said electronic switch is saturating.

4. Test apparatus as claimed in claim 3 in which a third of said comparator means is connected to provide its predetermined threshold signal whenever the voltage across the input terminals exceeds a predetermined high voltage indicating that a high voltage spike has appeared as a result of interruption of current flow through the primary winding.

5. Test apparatus is claimed in claim 1, claim 2 or claim 3 in which each of said comparator means has a peak storage circuit connected to its output.

6. Test apparatus as claimed in claim 4 in which each of said comparator means has a peak storage circuit connected to its output.

* * * * *